United States Patent [19]

Yeh et al.

[11] Patent Number: 4,994,949

[45] Date of Patent: Feb. 19, 1991

[54] STRETCHING DEVICE FOR A PLEATED LAMPSHADE

[76] Inventors: Chao H. Yeh; Chao K. Yeh, both of 3F-1, No. 28, Lane 265, Sec. 4, Sin Yi Rd., Taipei, Taiwan

[21] Appl. No.: 380,023

[22] Filed: Jul. 14, 1989

[51] Int. Cl.[5] ..... F21V 1/06

[52] U.S. Cl. ..... 362/352; 362/449; 362/434

[58] Field of Search ..... 362/324, 351, 352, 358, 362/434, 450, 452, 457, 458, 322, 355, 356, 277, 282, 449

[56] References Cited

U.S. PATENT DOCUMENTS 1,839,937 1/1932 Venner, Jr. ..... 362/358
4,714,987 12/1987 Dene ..... 362/352
4,758,936 7/1988 Maxwell ..... 362/352

FOREIGN PATENT DOCUMENTS 973447 9/1950 France ..... 362/434

*Primary Examiner*—Stephen F. Husar
*Assistant Examiner*—D. M. Cox
*Attorney, Agent, or Firm*—Thomas S. Keaty

[57] ABSTRACT

A stretching device for stretching a pleated lampshade, comprising an upper ring which inserts into the notches of the lampshade and a lower ring, both mounted on a threaded spindle, with the lower ring fixed or slidably retained and the upper ring slidably retained thereon. An adjusting nut is provided above the upper ring and a compression spring is received on the shaft between the two rings to bias the upper ring toward the adjusting nut.

1 Claim, 12 Drawing Sheets

STRETCHING DEVICE FOR A PLEATED LAMPSHADE

This invention relates to an improved stretching device for a pleated lampshade.

Referring to FIG. 1, a conventional stretching mechanism for a plated lampshade (L) comprises an upper stretching ring (R1) of smaller diameter and a lower stretching ring (R2) of greater diameter, which are fixedly mounted on a shaft (S). The inwardly protruding ridge (r1) of each pleat of the pleated lampshade (L) has an upper notch (N1) and a lower notch (N2). Referring to FIG. 2A, when the lampshade (L) is mounted in position, the rim of the upper stretching ring (R1) inserts into the upper notches (N1) and the rim of the lower stretching ring (R2) inserts into the lower notches (N2). The inherent resilience of the material of the lampshade (L) enables the latter to constrict the rings (R1) and (R2), thus maintaining a frustal shape. The lower end of the shaft (S) carries two wire loops (W) to fasten a bulb (B), thus supporting the lampshade at a height. Alternatively, instead of using wire loops, the lampshade can also be supported by two or three arms (A) extending from the socket to the lower ring (R2) (See FIG. 2B).

The disadvantage of such device consists in that the "spotlighted" area below the lampshade (i.e. the bright circular illuminated area below the lamp shade) is unchangeable, thus the user cannot increase or reduce the illuminated area to suit his purpose. Besides, the shape of the lampshade is also unchangeable (i.e. the inclination angle of the frustum is unchangeable), thus reducing the importance of the lampshade as a role in interior decoration.

The "spotlighted area" depends on the base area of the frustum. If one desires to adjust the illuminated area, one must change the base area of the frustum defined by the lampshade. On the other hand, the inclination angle of the lampshade depends on the diameters of the rings and the distance therebetween. In the conventional device, the notches (N1), (N2) are provided at definite positions of the lamspshade (L), whereas the diameters of the two stretching rings (R1), (R2) and the distance between the two rings are fixed, that means the shape of the frustum is unchangeable. Thus an adjustment of the "spotlighted area" and a change of the shape of the lampshade is impossible.

To obviate this disadvantage, the applicant proposed two ways of solution before. The first solution is shown in FIGS. 3A and 3B. Apart from the notches (N1), (N2) on the inner ridges (r1), further notches (N3), (N4) are provided on the outer ridges (r2). The lampshade (L1) can be turned inside out, thus the ridges (r1) protrude outwardly, and the ridges (r2) protrude inwardly, and the rings (R1), (R2) can be inserted into the notches (N4) and (N3). (See FIG. 3B). The inside-out conversion can cause the change of the base area of the frustum, thus changing the "spotlighted area". Nevertheless, the inclination of the frustum remains the same. Moreover, only two different kinds of spotlighted area are possible, and the increase of notches causes the strength of the lampshade to deteriorate.

The second solution is shown in FIG. 4. The upper ring (R2) is canceled and replaced by a spring (SP) which passes through a slot (SL) provided on each pleat. By selecting proper length of the spring (SR), the inclination angle of the frustum and the spotlighted area can be changed. However, this device necessitates several different springs (SP) to make coresponding number of possibilities of adjustment.

Accordingly, it is the object of this invention to provide an improved stretching mechanism to obviate the aforesaid disadvantages.

According to this invention, the upper ring (R1) is not fixed on the shaft (S), but axially slidably retained thereon. By changing the axial position of the upper ring (R1), both the shape of the lampshade and the spotlighted area can be varied. Practically the shaft is in form of a threaded spindle, on which an adjusting nut is provided to define the upper limit of the upper ring (R1). A compression spring is received on the spindle to bias the upper ring upwardly toward the adjusting nut.

When the distance between the two rings (R1), (R2) changes, the distance between the rim of upper ring (R1) and the rim of lower ring (R2) also changes. Thus only one of the rims can be fixed on the lampshade. That means either of the upper notches (N1) or the lower notches (N2) must be canceled. According to this invention, it is the lower notches (N2) that are canceled. Thus it is the upper ring (R1) that is fixed to the lampshade. However, if desired, it is also possible to cancel the upper notches (N) so that it is the lower ring (R2) that is fixed to the lampshade. When the distance between the two rings is being changed, the lampshade slides along the rim of the lower ring (R1).

This invention will be better understood when read in connection with the drawing in which:

DETAILED DESCRIPTION OF PREFERRED EMBODIMENT

Figure 1:
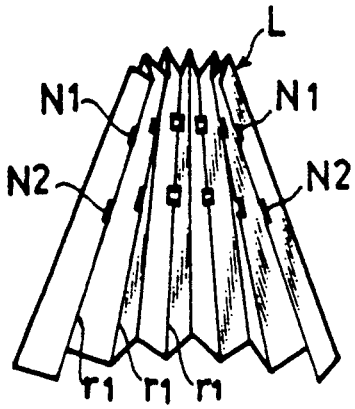
FIG. 1 PRIOR ART
FIG. 1 is a perspective view of a conventional stretching device and a pleated lampshade.
Figure 1:
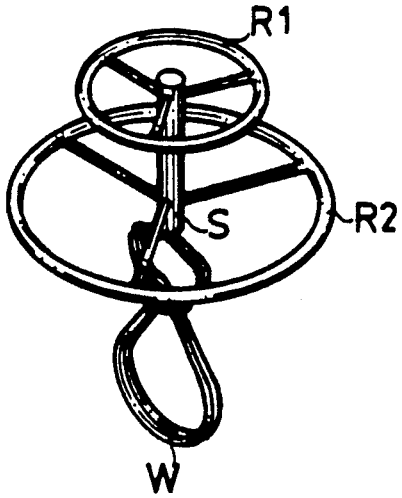
FIG. 1 PRIOR ART
Figure 2A:
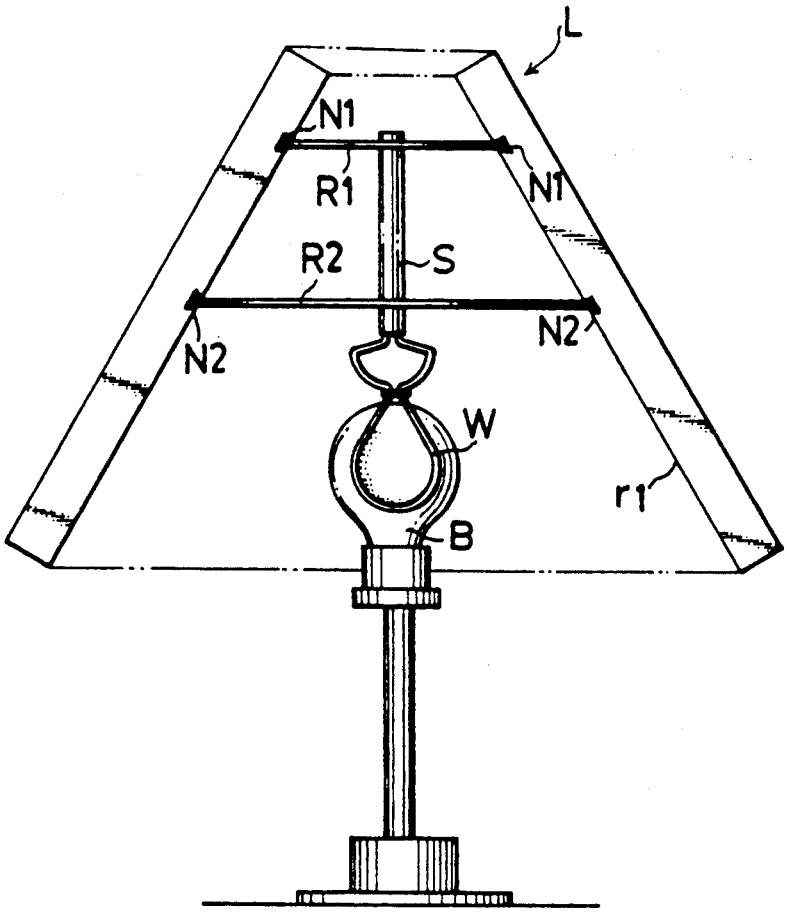
FIG. 2A PRIOR ART
FIGS. 2A and 2B are the elevational views of a conventional lamp with different supporting means.
Figure 2B:
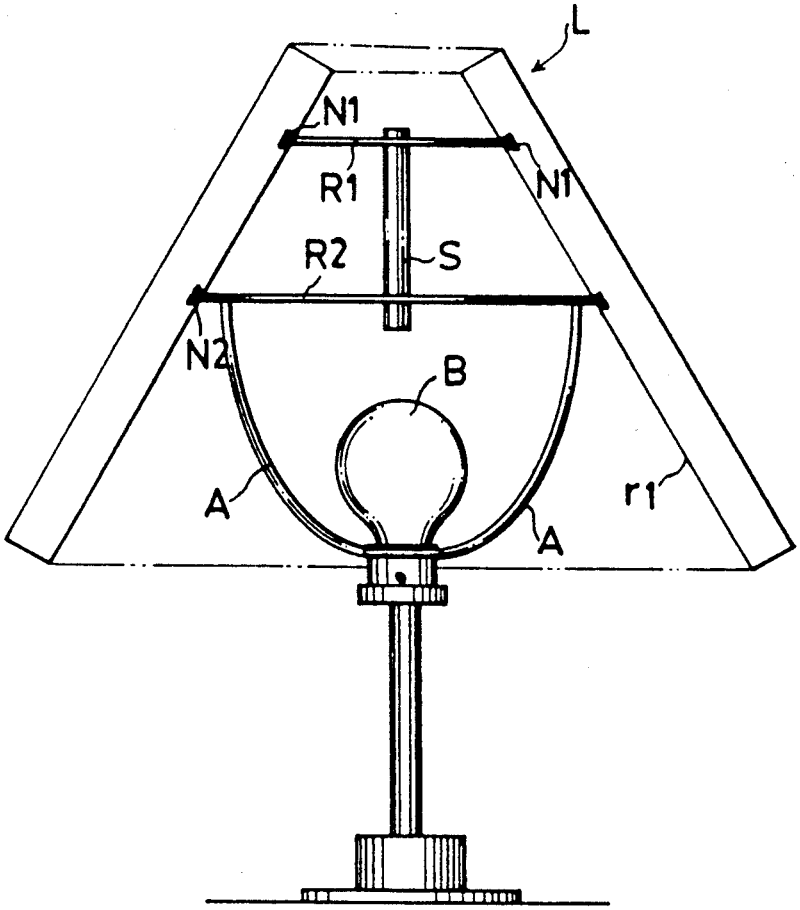
FIG. 2B PRIOR ART
Figure 3A:
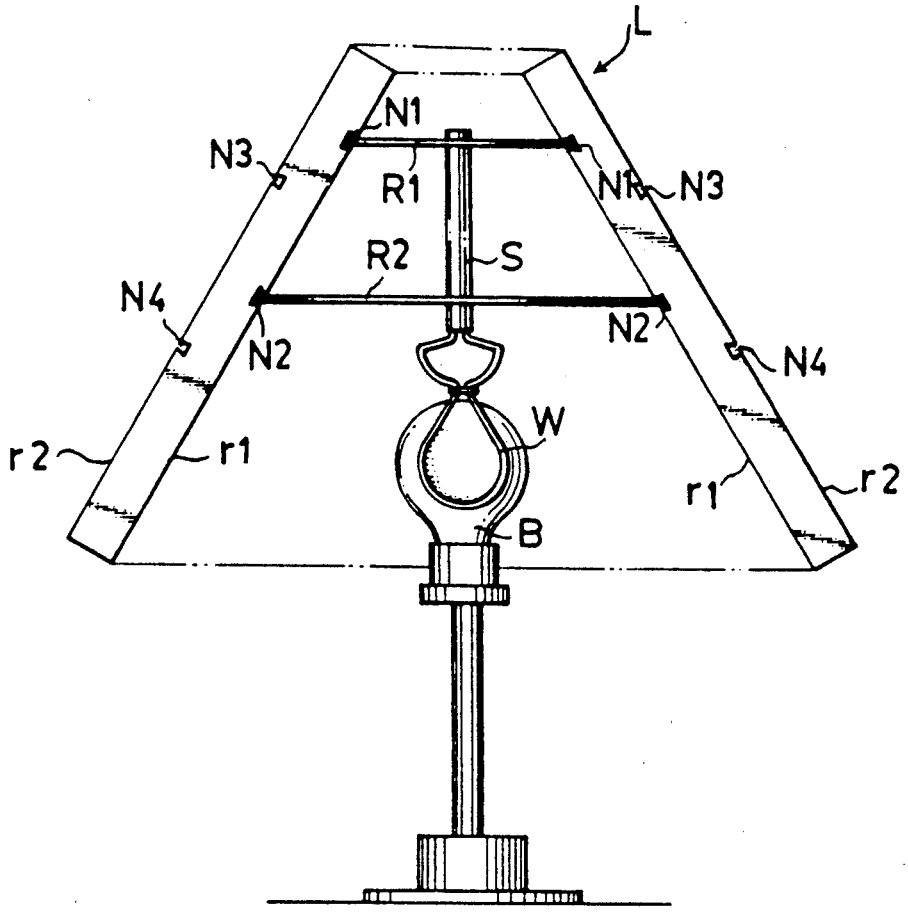
FIG. 3A PRIOR ART
FIG. 3A is an elevational view of another conventional lamp.
Figure 3B:
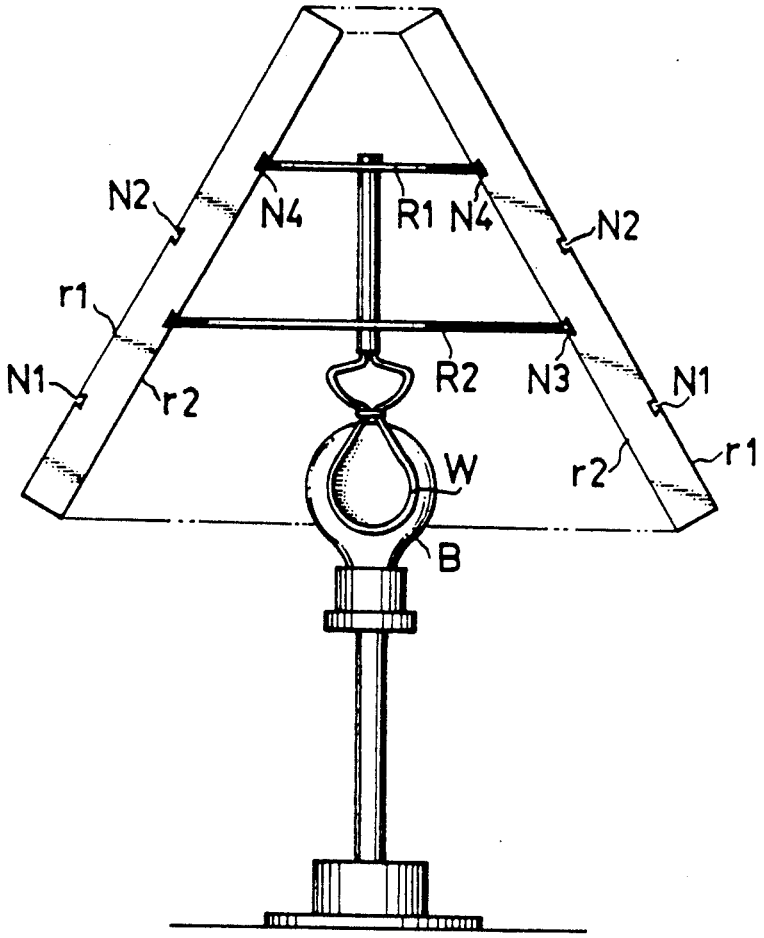
FIG. 3B PRIOR ART
FIG. 3B is an elevational view of the lamp in FIG. 3A with the lampshade turned inside out.
Figure 4:
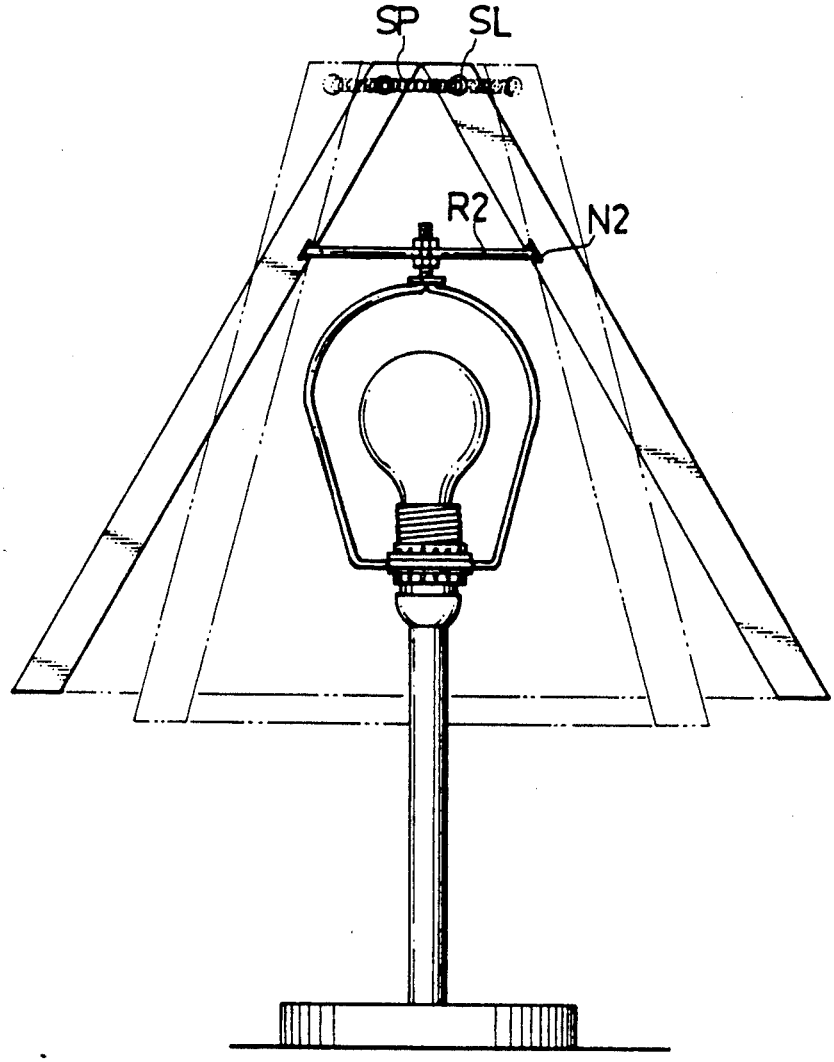
FIG. 4 PRIOR ART
FIG. 4 is an elevational view of another conventional lamp.
Figure 5:
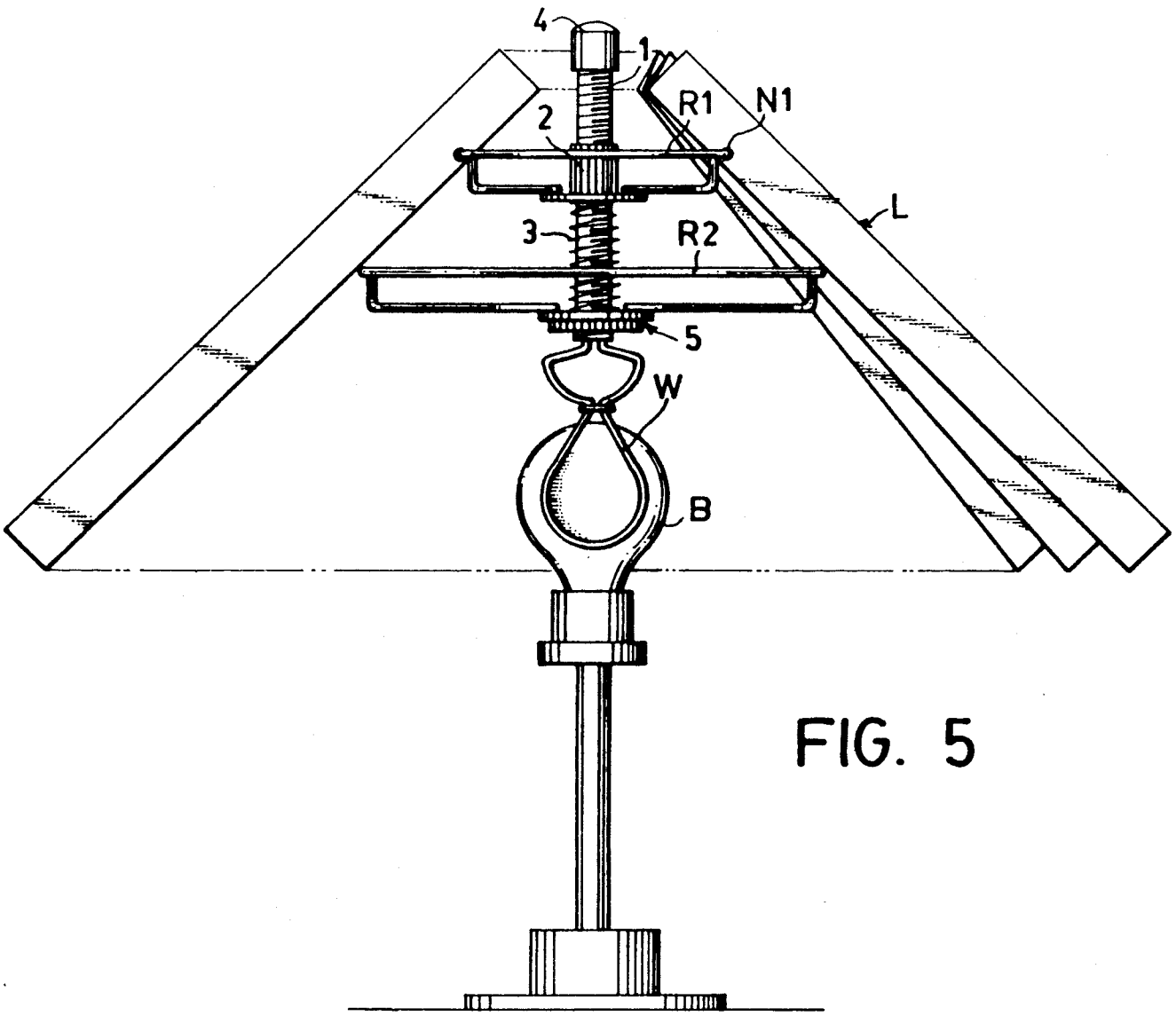
FIG. 5 is a perspective view of a lamp provided with this invention.
Figure 6:
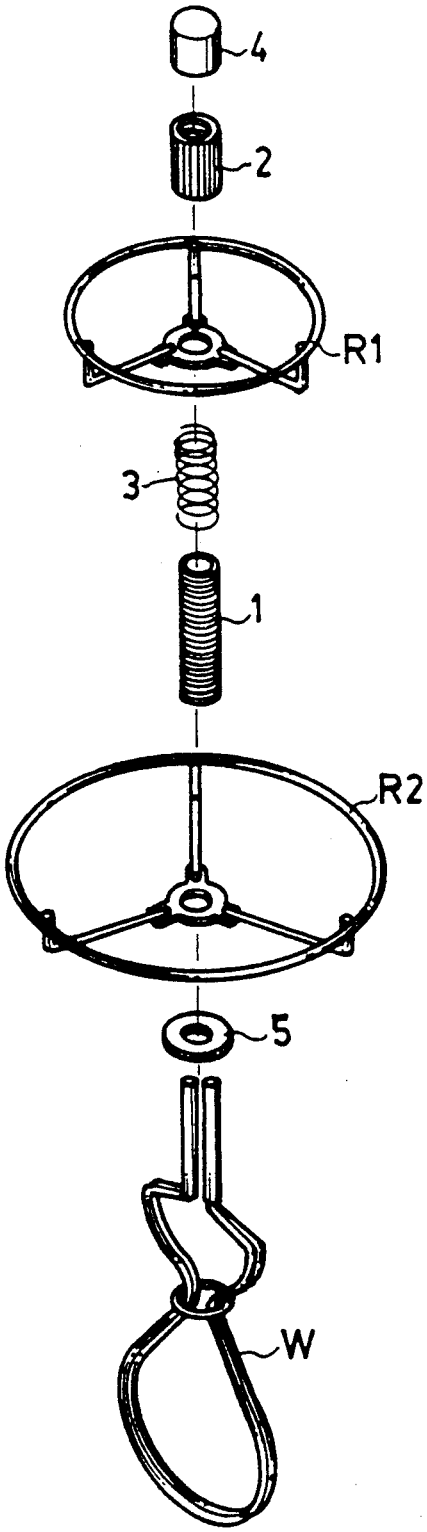
FIG. 6 is an exploded view of the device of this invention.
Figure 7:
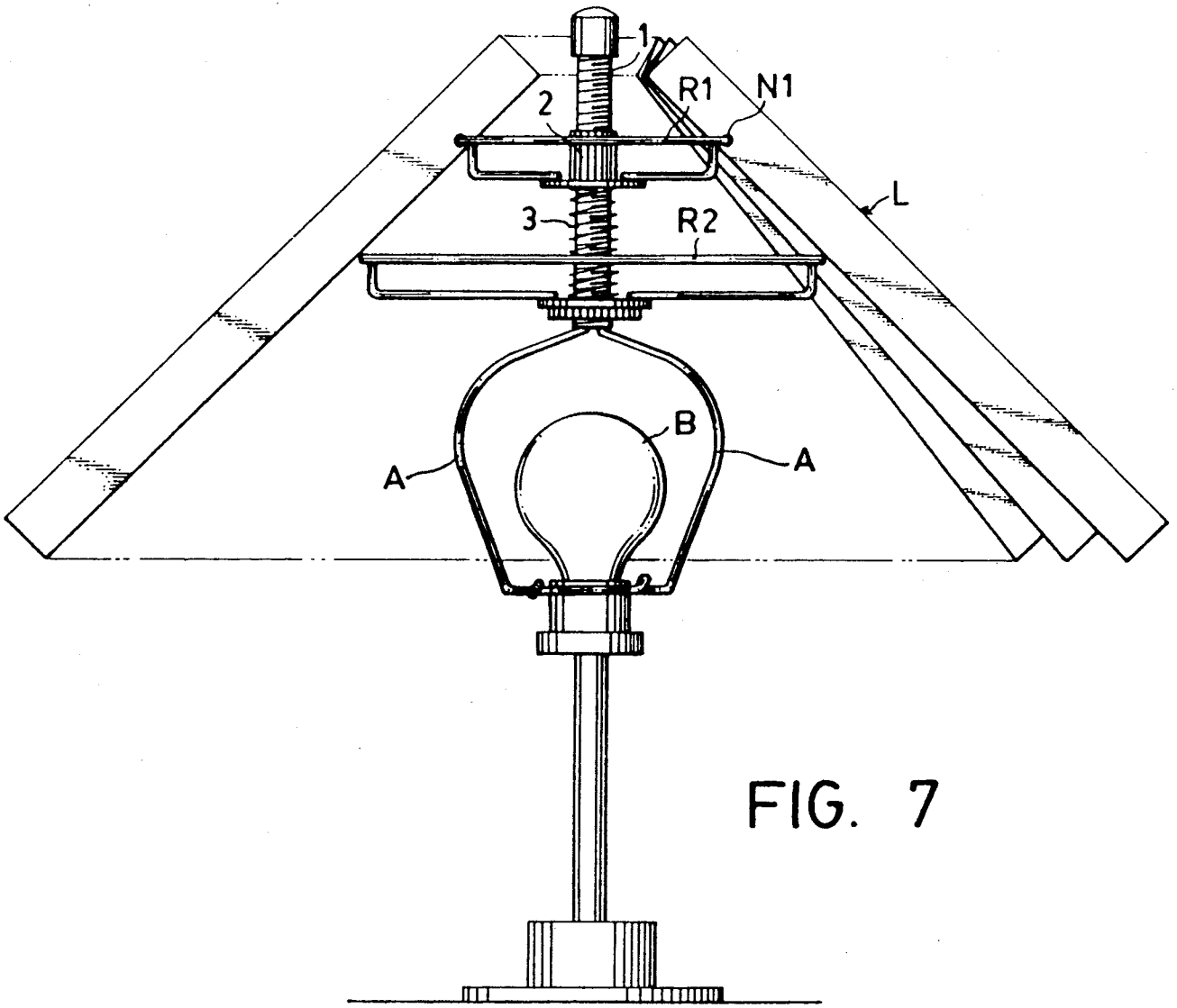
FIG. 7 is a perspective of a lamp provided with this invention, using different supporting means.

Referring to FIG. 5, the stretching device differs with the conventional device in FIG. 1 only in a threaded spindle (1), and adjusting nut (2), and a spring (3), while the remaining elements are sustantially the same as that of the prior art. The lower ring (R2) is fixed or slidably retained at the lower end of the threaded spindle (1), while the upper ring (R1) is slidably retained thereon, and is biased upward against the adjusting nut (2) by the compression spring (3). An upper nut (4) and a lower nut (5) are provided to limit the elements (2), (R1), (3) and (R2) to retain on the spindle (1). By adjusting the adjusting nut (2) the height of the upper ring (R1) can be varied, thus changing both the shape of the lampshade and the spotlighted area. Of course, if the lower ring (R2) is not fixed, but slidably retained on the spindle (1), it is also possible to change the shape of the lampshade by turning the lower nut (5).

As stated before, no lower notches are provided on the lampshade for the lower ring (R2). Thus the lower ring serves only to stretch the lamspshade, and does not provide an attaching point for it. The upper notch (N1) is also slightly modified to more securely engage with the rim of the upper ring (R1).

Figure 8A:
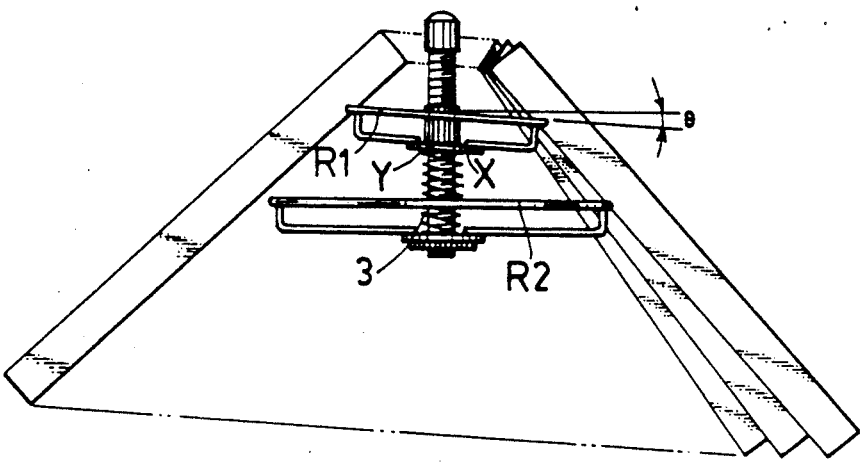
FIG. 8A and FIG. 8B shows the automatic shape-correcting function of this invention.
Figure 8B:
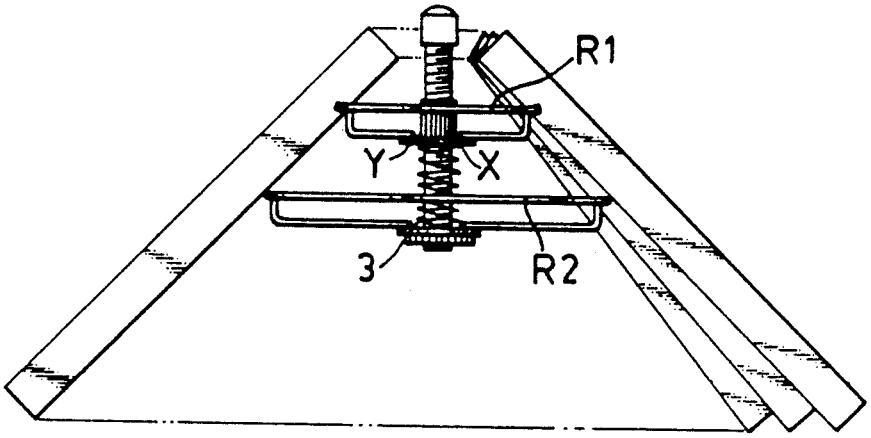
Figure 9A:
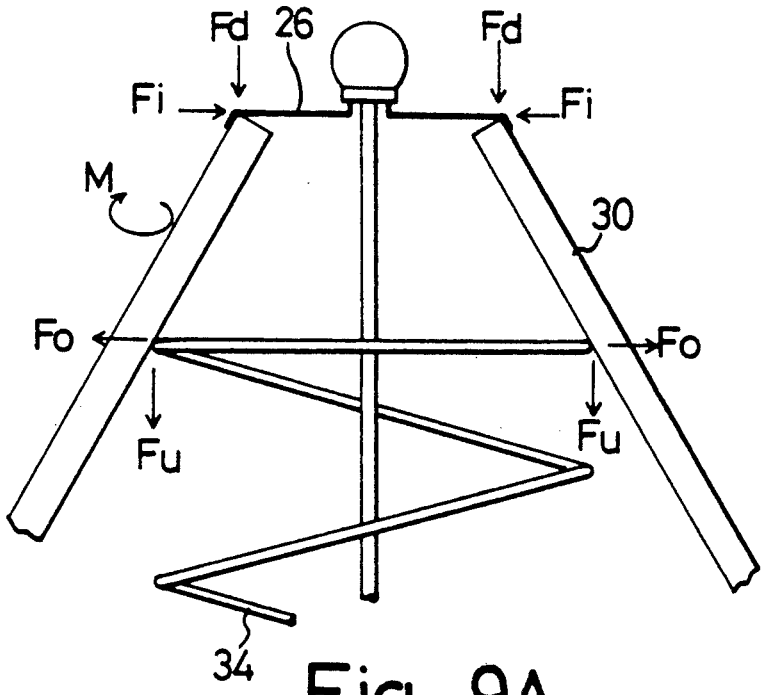
Figure 9B:
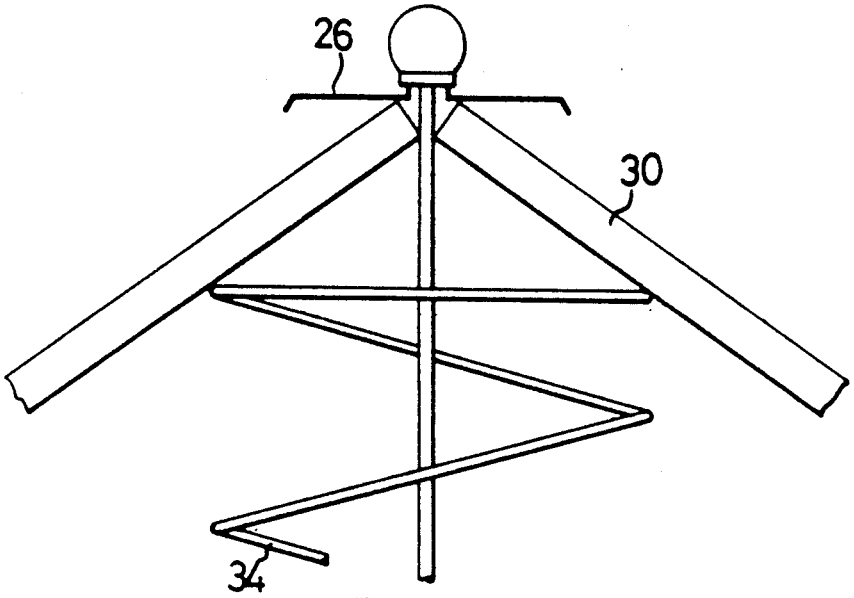
Figure 9C:
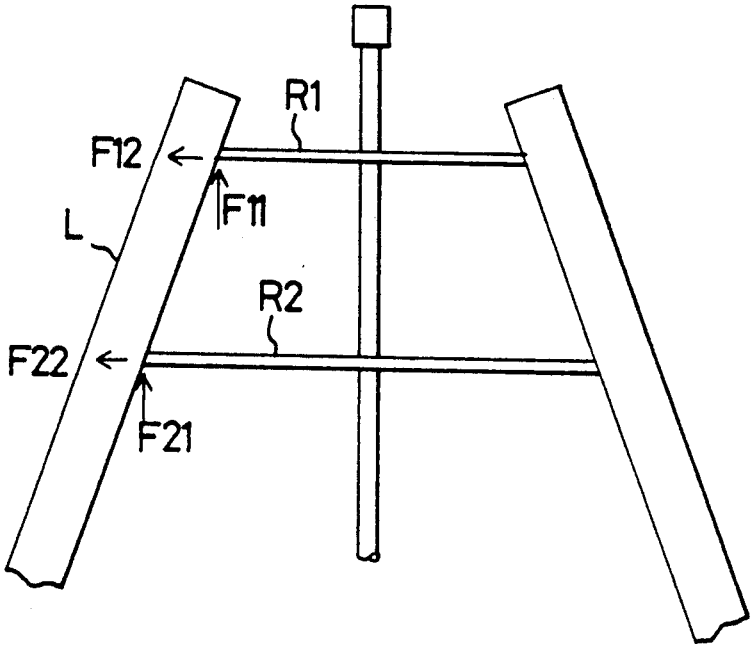

Last, but not least, the present invention has an "automatic shape-correcting" function which the conventional devices cannot equal. The auto-correction results from the spring (3). It is well-known that the rings (R1), (R2) are difficult to be made accurately regularly circular. In many cases, the rim of a ring (R1) or (R2) is not strictly located in a plane, but distorted more or less. Thus, when fastened on the shaft (S), the rims of the two rings (R1), (R2) may not be parallel to each other. As a result, the shape of the lampshade stretched by the rings (R1), (R2) is not regularly frustal and gives an unsightly and unbalanced appearance. With the present invention, this problem does not exist. Referring to FIG. 8A, if the upper ring (R1) inclines slightly, to the right side by an angle the (a) the right side (X) of the central portion of the ring (R1) will be subject to a greater push of the spring than the left side (Y) thereof. Hence the right side of the ring (R1) is pushed upward until the upper the right side of the ring (R1) is pushed upward until the upper ring (R1) is strictly parallel to the lower ring (R2) (see FIG. 8B), thus achieving an auto-correction.

We claim:

1. A stretching device for stretching a pleated lampshade, comprising:

a threaded spindle;

a first ring coaxially mounted on said spindle, said first ring exerting an upward and outward force on the inner side of said lampshade;

a coil spring axially received on said spindle, with its lower end urging against said first ring;

a second ring having a smaller diameter than said first ring and mounted coaxially on said spindle in a vertically spaced-apart relationship from said first ring;

an adjusting nut mounted on said spindle above said second ring, wherein each pleat of said lampshade is provided with a notch into which said second ring is inserted;

and wherein said second ring is axially slidably retained on said spindle, while an upper end of said coil spring urges said second ring against said adjusting nut.

* * * * *